United States Patent [19]

Spies et al.

[11] Patent Number: 4,676,166

[45] Date of Patent: Jun. 30, 1987

[54] APPARATUS FOR DETONATING A MINE HAVING A HOUSING REALIZED AS A SPHERE OR A BODY OF ROTATION

[75] Inventors: Hans Spies, Pfaffenhofen; Alfons Wöhrl, Schrobenhausen; Roland Schmidt, Gröbenzell, all of Fed. Rep. of Germany

[73] Assignee: Messerschmitt-Bölkow-Blohm GmbH, Munich, Fed. Rep. of Germany

[21] Appl. No.: 826,271

[22] Filed: Feb. 5, 1986

[30] Foreign Application Priority Data

Feb. 6, 1985 [DE] Fed. Rep. of Germany ..... 3503919

[51] Int. Cl.[4] ..... F42B 23/26; F42C 13/08

[52] U.S. Cl. ..... 102/362; 102/215; 102/427

[58] Field of Search ..... 102/362, 427, 401, 215

[56] References Cited

U.S. PATENT DOCUMENTS 4,112,844 9/1978 Held et al. ..... 102/427
4,580,497 4/1986 Erdmann et al. ..... 102/427

FOREIGN PATENT DOCUMENTS 2608067 9/1977 Fed. Rep. of Germany .
3345362 6/1985 Fed. Rep. of Germany ..... 102/362
3345363 6/1985 Fed. Rep. of Germany .

*Primary Examiner*—Charles T. Jordan
*Attorney, Agent, or Firm*—Kenyon & Kenyon

[57] ABSTRACT

A device for detonating a rolling mine upon impact or collision with a target by a linkage of sensors which detect physical criteria independent of each other in a sequence predetermined in time, a signal processor connected thereto delivering a firing signal for detonating the mine at the proper time.

5 Claims, 4 Drawing Figures

APPARATUS FOR DETONATING A MINE HAVING A HOUSING REALIZED AS A SPHERE OR A BODY OF ROTATION

BACKGROUND OF THE INVENTION

The present invention relates to a device for detonating a mine having a housing realized as a sphere or a body of rotation which comprises several propulsion mechanisms with radial to tangential directions of thrust, and an explosive charge with a detonator and a safety device, and a sensor for the magnetic field surrounding the mine and a further sensor as well as an evaluation circuit for the sensor signals for detonating the mine.

For mining large areas with a small number of mines, so-called rolling mines are employed such as are known from German application No. P 33 45 363.2. These mines have a housing shaped as a sphere or a body of rotation, whereby they can move on the terrain by means of propulsion mechanisms which are built into the housing and can be triggered successively. If such a mine hits a target during its process of motion, the built-in proximity or contact sensors respond and detonate the explosive charge.

In DE-OS No. 26 08 067, a detonation circuit for throwable hollow-charge ammunition is described which contains a metal detector and a further sensor, for instance, an impact sensor, the outputs of which are linked together via a circuit member (AND gate).

While the above-mentioned embodiments of detonators allow the recognition of an impact on a metallic target, they do not permit the elimination of the influence of interference quantities or unintended targets on the triggering of the detonation.

SUMMARY OF THE INVENTION

It is therefore an object of the present invention to provide a device for detonating a rolling mine which can detect a target and detonate the mine during the rolling motion of the mine upon impact on or collision with an intended target, and which is free from errors due to unintended targets or influences resulting from the motion of the mine and the driving pulses of the propulsion mechanisms.

The above and other objects of the present invention are achieved by an apparatus for detonating a mine having a housing defining a body of rotation which comprises a plurality of propulsion means distributed over the circumference of the body of rotation and capable of exerting thrust in radial to tangential directions, an explosive charge having a detonator and a safety device, and further comprising at least one means for sensing the magnetic field surrounding the mine and first signal processing circuit means for processing signals from the sensing means and providing a first output signal, the first output signal being coupled to first threshold comparator means for generating a second output signal after an adjustable signal threshold is exceeded, the second output signal being coupled to first time delay means, an output of the first time delay means being coupled to a first input of logic circuit means, means for sensing the acceleration acting on the mine and second signal processing circuit means for processing signals from the acceleration sensing means which comprises a reset input and a resettable integrator means, an output of the second signal processing circuit means being coupled to a second threshold comparator means which generates a third output signal after an adjustable signal threshold is exceeded, the third output signal being coupled to a second input of the logic circuit means, and second time delay means responsive to the triggering of at least one of the propulsion means, an output signal of the second time delay means resetting the first time delay means and setting the integrator means to an initial state and maintaining the initial state over the delay time of the second time delay means.

BRIEF DESCRIPTION OF THE DRAWINGS

The invention will be explained in greater detail in the following detailed description with reference to the drawings in which.

DETAILED DESCRIPTION

Figure 1:
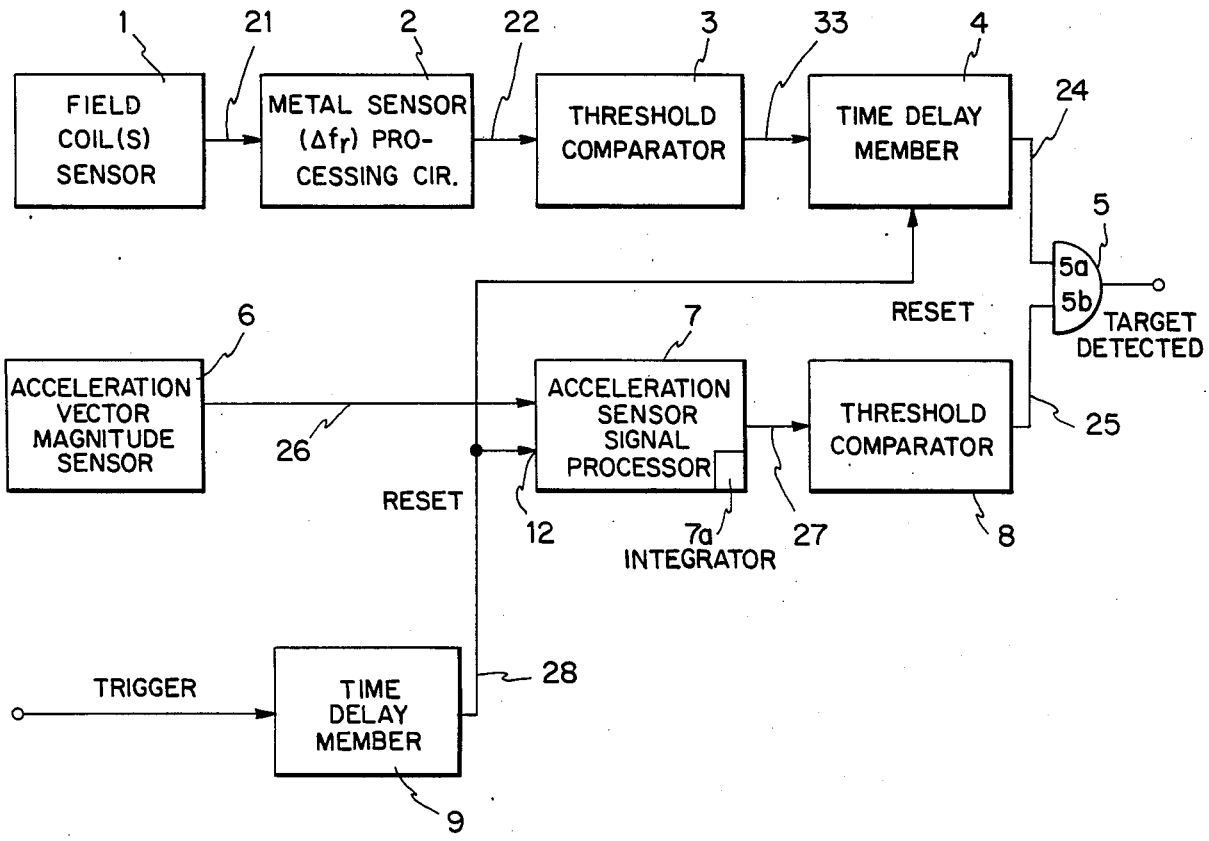
FIG. 1 shows an embodiment of a device for detonating a rolling mine by means of target detection sensors.

With reference now to the drawings, FIG. 1 shows a device for detonating a rolling mine, using two sensors 1 and 6 for target detection. Both sensor channels process, initially independently of each other, their respective pick-up signals 21, 26. The output signals 24, 25 resulting from the pick-up signal processing are linked to each other in a logic member 5 to form a detonation signal.

Figure 4:
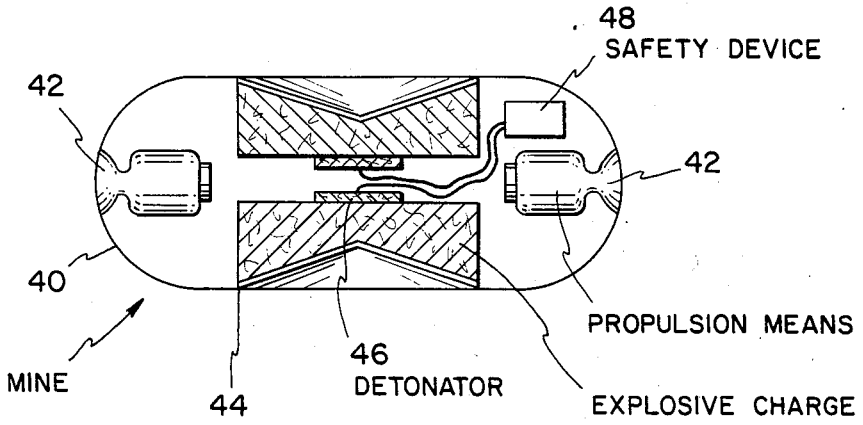
FIG. 4 shows one embodiment of a rolling mine.

FIG. 4 shows a typical rolling mine. The mine includes a housing 40 defining a body of rotation, a plurality of propulsion means 42 distributed over the circumference of the body of rotation and capable of exerting thrust in radial to tangential directions, an explosive charge 44 having a detonator 46 and a safety device 48.

Figure 2:
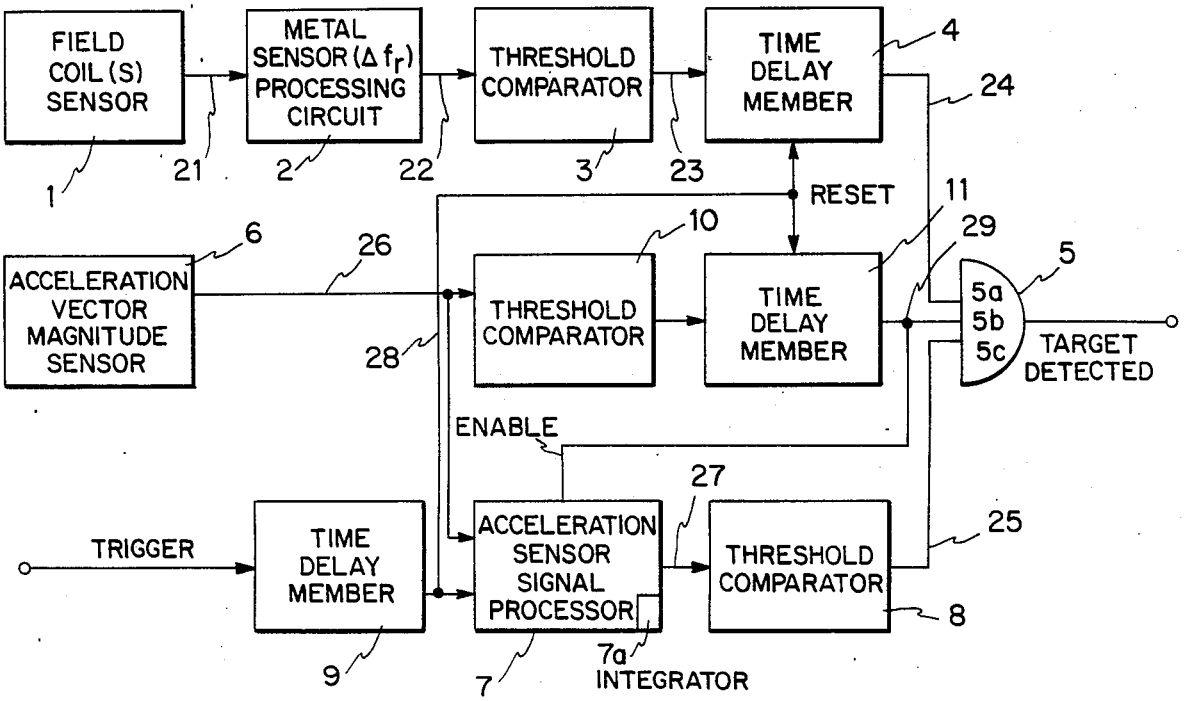
FIG. 2 shows another embodiment of a device for detonating a rolling mine.

In the embodiments of the device for detonating a rolling mine according to FIGS. 1 and 2, an approach to metallic articles is detected as the first actuating variable. For this purpose, one or several field coils 1 are provided on the housing surface of the rolling mine in a definite arrangement in space. These coils are connected to a pick-up signal processing device 2 which comprises one or more active resonant circuits. The resonance frequency changes $\Delta f_r$ resulting in the tuned circuits when the rolling mine approaches a metal object are picked up while slow, drift-dependent frequency changes are suppressed. The pick-up signal processing device 2 generates an output signal 22 which is coupled to a threshold comparator 3. If a threshold of the threshold comparator 3 is exceeded, the following retriggerable time delay member 4 is triggered by the signal 23. Thereby, the the delay time of the time delay member 4 is triggered, and one of ar least two independent physical conditions for the release of the detonation is met, namely, a positive signal 24 is provided after a delay time at one input 5*a* of the logic circuit 5, in this case an AND gate.

Figure 3:
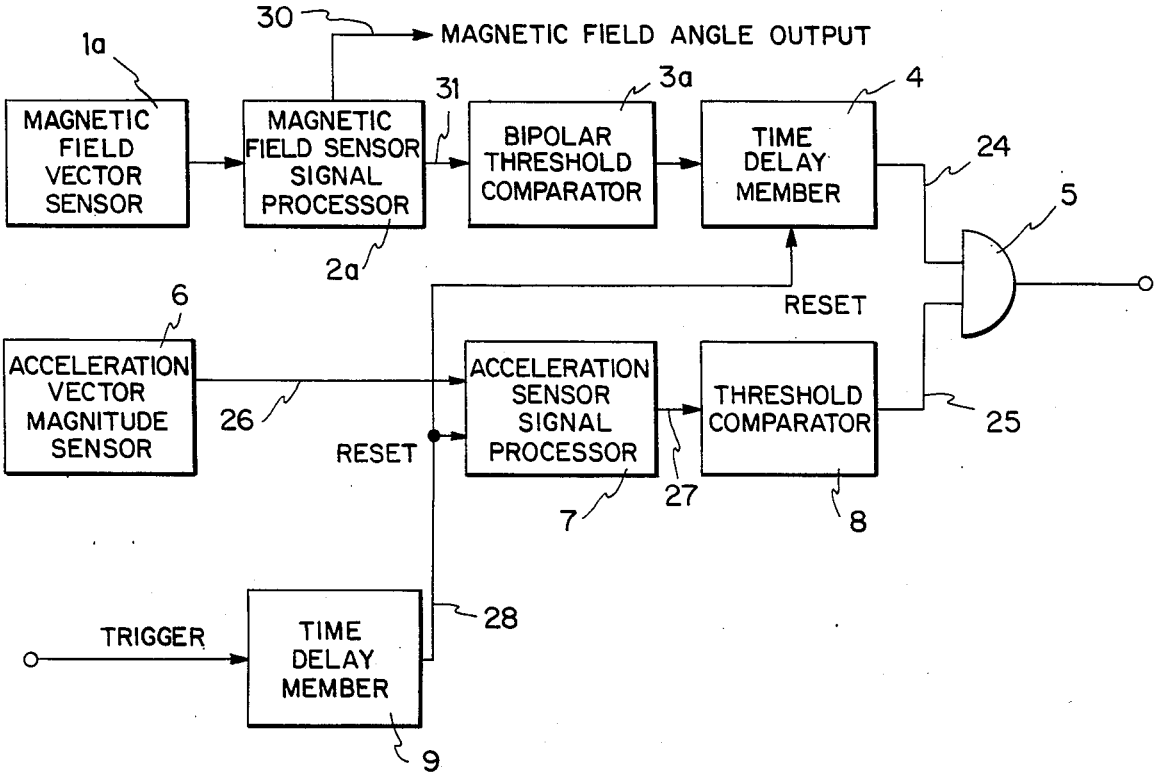
FIG. 3 shows a further embodiment of a device for detonating a rolling mine with a sensor for picking up the earth's magnetic field.

In all three embodiments of the device for detonating a rolling mine such as are shown in FIGS. 1, 2 and 3, the amount of the accelerations acting on the center of the rolling mine is detected and evaluated for target recognition. For this purpose, an acceleration sensor 6 is provided, the output signal 26 of which is processed in a further pickup signal processing device 7. The latter contains an integrator 7a which can be reset by means of the reset input 12 and, in the embodiment according to FIG. 2, an integrator 7a which can be activated by a separate signal line 29 (enable). If the integrator is activated and a pickup signal 26 with a value corresponding to more than 0 m/sec is present, the integrator of FIG. 2 continuously adds a fixed necative amount of acceleration to the negative amount of acceleration acting on the rolling mine (deceleration). Thereby, the "interference" delays that occur are effectively suppressed. If the output voltage 27 of the further pickup signal processing device 7 exceeds the threshold voltage of the further threshold comparator 8, the latter delivers an output signal 25 to the further input 5b of the logic member 5. Thereby, the second independent physical condition for triggering the detonation is met and, in the circuit embodiments according to FIGS. 1 and 3, a detonation signal would be present at the output of the logic member 5. Thus, the embodiments shown detect a predetermined threshold value of the velocity reduction, caused by the impact on or a collision with the target, neglecting the "interference" delays, which are suppressed.

In the embodiment of the device for detonating a rolling mine according to FIG. 2, there is provided for the output signal 26 of the further pickup 6, a series circuit arranged parallel to the already described signal processor of a third threshold comparator 10 and a third time delay member 11, the output line 29 of which is connected on one hand to a third input 5c of the logic member 5 and on the other hand, to the activating input (enable) of the integrator 7a of the pickup signal processing device 7. Thus, the integrator 7a is active only if a predetermined delay threshold was exceeded. This condition is preserved over the delay time of the time delay member 11 following the third threshold comparator 10. From the threshold dependence of the integrator, an additional degree of freedom is thereby obtained for the suppression of interference quantities in the measurement of the acceleration and the acceleration signal processing.

The embodiment of the circuit according to FIG. 3 comprises a magnetic field signal branch pickup 1a and signal processing device 2a. In this embodiment, the change of the magnitude of the earth's magnetic field by the target is determined. For this purpose, a pickup 1a for the magnetic field and a pickup signal processing device 2a with outputs for the magnitude 31 and the angle 30 of the magnetic field are provided. The output signal 31 is coupled to a bipolar threshold comparator 3a. If the magnitude of the measured change of the magnetic field exceeds the threshold value of the threshold comparator 3a, the threshold comparator starts the following retriggerable time delay member 4. Thereby, one of the necessary conditions for triggering the detonation is met again.

All three embodiments of the device for detonating a rolling mine according to FIGS. 1 to 3, have a further signal path including the delay time member 9. The latter is started by a signal from the addressing of the propulsion of the rolling mine, for instance, a motor control or a pulse for the firing of a propulsion mechanism. The time delay member 9 is connected to the reset inputs of all other time delay members 4, 11 and resets the latter and the integrator 7a of the acceleration signal processor 7 to the output value 0 and maintains this state during this entire time delay. The time delay of the time delay member 9 corresponds at the minimum of its value to the maximum of the delay time of a propulsion mechanism.

The special advantage of the device according to the invention for detonating a rolling mine is that a sensor arrangement for target detection has been provided at low cost which is capable of separating the interference quantities typical of a rolling mine such as unevenness and rocks along the rolling path as well as the acceleration pulses of the propulsion mechanism reliably from the characteristic features of a target impact.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than a restrictive sense.

What is claimed is:

1. Apparatus for detonating a mine having a housing defining a body of rotation which comprises a plurality of propulsion means distributed over the circumference of said body of rotation and capable of exerting thrust in radial to tangential directions, an explosive charge having a detonator and a safety device, and further comprising:

at least one means for sensing the magnetic field surrounding the mine and first signal processing circuit means for processing signals from the sensing means and providing a first output signal, said first output signal being coupled to first threshold comparator means for generating a second output signal after an adjustable signal threshold is exceeded, said second output signal being coupled to first time delay means, an output of the first time delay means being coupled to a first input of logic circuit means;

means for sensing the acceleration acting on the mine and second signal processing circuit means for processing signals from the acceleration sensing means which comprises a reset input and a resettable integrator means, an output of said second signal processing circuit means being coupled to a second threshold comparator means which generates a third output signal after an adjustable signal threshold is exceeded, said third output signal being coupled to a second input of the logic circuit means; and second time delay means responsive to the triggering of at least one of the propulsion means, an output signal of the second time delay means resetting said first time delay means and setting said integrator means to an initial state and maintaining said initial state over the delay time of the second time delay means.

2. The apparatus for detonating a mine recited in claim 1, wherein an output signal of the acceleration sensing means is coupled to third threshold comparator means, an output of the third threshold comparator means being coupled to a third time delay means, an output of said third time delay means being coupled to a third input of the logic circuit means and to an input of the integrator means for enabling said integrator means.

3. The apparatus for detonating a mine recited in claim 2, wherein the integrator means is responsive to said input for enabling for placing said integrator means in an active state and if an output signal of the acceleration sensing means corresponding to a value greater than 0 m/sec is detected, said integrator means integrates continuously a selectable constant negative amount together with an actual amount of deceleration acting on the mine.

4. The apparatus for detonating a mine recited in claim 1, wherein the means for sensing the magnetic field surrounding the mine comprises at least one tuned circuit comprising coil means, and wherein the resonance frequency of the tuned circuit resulting from an approach to a metal object is evaluated and slow drift-dependent frequency changes are suppressed.

5. The apparatus for detonating a mine recited in claim 1, wherein the means for sensing the magnetic field surrounding the mine and said first signal processing circuit means comprises magnetic field vector sensor means having circuit means connected thereto for signal processing and providing an output signal proportional to a magnetic field angle, and a further output signal proportional to an intensity of the magnetic field, said further output signal coupled to said first time delay means by said first threshold comparator means comprising bipolar threshold comparator means.

* * * * *